US007536732B1

(12) United States Patent
Dunlap

(10) Patent No.: US 7,536,732 B1
(45) Date of Patent: May 26, 2009

(54) TOILET SEAT SHOCK ABSORPTION AND SLIDE PREVENTION DEVICE

(76) Inventor: Creig Albert Dunlap, 54 Fairview Dr., Hillsboro, MO (US) 63050

( * ) Notice: Subject to any disclaimer, the term of this patent is extended or adjusted under 35 U.S.C. 154(b) by 0 days.

(21) Appl. No.: 12/072,726

(22) Filed: Feb. 29, 2008

(51) Int. Cl.
*A47K 13/00* (2006.01)

(52) U.S. Cl. ..... 4/237

(58) Field of Classification Search ..... 4/237–241
See application file for complete search history.

(56) References Cited

U.S. PATENT DOCUMENTS 2,964,179 A 12/1960 Loevenstein
3,220,693 A 11/1965 Dickson
4,214,323 A 7/1980 Thomas
5,708,989 A 1/1998 Ellis
5,806,109 A 9/1998 Hargaden
7,216,374 B2 5/2007 Hassan

*Primary Examiner*—Huyen Le
(74) *Attorney, Agent, or Firm*—Theresa M. Seal

(57) ABSTRACT

A toilet seat device removably attachable to the underside of the toilet seat for preventing the toilet seat from sliding back and forth and for shock absorption when the toilet seat is dropped includes a bracket having a lip portion and a leg portion with the lip portion extending downwardly against the toilet rim and the leg portion having a recess for receiving therein a rubber bumper insert member that faces the toilet rim and provides for the shock absorption when the toilet seat is dropped. The bracket includes an interior attaching surface that comprises both the leg portion and the lip portion, and the interior attaching surface further includes a grid matrix to increase surface area contact between the bracket and toilet seat underside when glue bonding is used, and the insert member includes through holes that align with a slot formed on the leg portion for also screwing the bracket to the toilet seat underside.

6 Claims, 5 Drawing Sheets

TOILET SEAT SHOCK ABSORPTION AND SLIDE PREVENTION DEVICE

FIELD OF THE INVENTION

The present invention pertains to attachments and accessories for toilets, and especially for toilet seats, and more particularly pertains to a device attachable to the underside of the toilet seat to provide for shock absorption and slide prevention of the toilet seat relative to, and in interaction with, the rim of the toilet bowl.

BACKGROUND OF THE INVENTION

Toilet seats take an enormous amount of physical abuse in the form of weight applied to them in an uneven manner when they are used, and also when the are abruptly released and dropped on the rim of the toilet bowl. This physical abuse is exacerbated by the manner in which toilet seats are designed and mounted to the rear of the toilet bowl. A toilet seat is basically designed in the shape of a horseshoe open at a distal end and pivotally or hingably mounted at the closed opposite end to a seat support. The seat support often comprises a bar extending between and pivotally mounted to two spaced-apart upright hinges or brackets with the toilet seat interconnected at its rear end to the bar by support members. Another type of pivotal mounting includes a pair of spaced-apart, upwardly projecting brackets mounted to the rear of the toilet seat and which pivotally engage pins or dowels that extend from supports mounted to the rear of the toilet seat. In any case, toilet seats receive an enormous amount of wear, abuse, and neglect from being abruptly dropped onto the rim of the toilet bowl, from being slid back and forth upon the rim, and from constantly having weight placed upon the seat in an uneven manner. Thus, it would be desirable to design the toilet seat, or design attachments for the toilet seat, that will prevent the toilet seat from sliding back and forth for maintaining the position of the toilet seat relative to the rim of the toilet bowl thereby diminishing wear, abuse, and neglect, and thus the need for repair and replacement. The prior art discloses a variety of designs and accessories for toilet seats.

For example, the Thomas patent (U.S. Pat. No. 4,214,323) discloses a raised toilet seat apparatus that includes an anti-tipping structure that comprises a pair of I-shaped brackets connected to a raised toilet seat.

The Ellis patent (U.S. Pat. No. 5,708,989) discloses a toilet seat assembly that includes a toilet seat and a seat holding bar assembly for removably holding the seat on the toilet bowl.

The Hargaden patent (U.S. Pat. No. 5,806,109) discloses a seat and bucket arrangement for use as a toilet in small boats lacking conventional toilet facilities.

The Hassan patent (U.S. Pat. No. 7,216,374 B2) discloses a smart toilet seat that includes spray nozzles for spraying the interior of the toilet seat and a suction outlet and exhaust motor for drawing odors out from the toilet seat.

Nonetheless, despite the ingenuity of the above devices, there remains a need for a device that is removably attachable to the underside of the toilet seat at one or more spaced locations thereon, and which reduces wear, repair, and maintenance on the toilet seat by preventing the sliding of the toilet seat relative to the rim of the toilet bowl, and also provides for shock absorption when the toilet seat is dropped onto the toilet bowl rim.

SUMMARY OF THE INVENTION

The present invention comprehends a device for placement on the underside of a toilet seat for preventing the toilet seat from sliding back and forth upon the upper rim of the toilet bowl and for shock absorption by lessening and reducing the amount of damage to the toilet seat when the toilet seat is dropped on or abruptly released on the upper rim of the toilet bowl. Generally more than one toilet seat device—preferably four devices—are spaced about the underside of the toilet seat and secured thereto with one preferred disposition being the three and four and eight and nine positions (relative to the toilet seat being fully lifted up against the water closet or toilet tank).

Thus, the toilet seat device of the present invention includes an I-shaped bracket, preferably of a durable, long lasting, high impact plastic material, having a lip portion and a leg portion. The bracket includes an outer toilet bowl side and an interior attaching surface both of which are coextensive with the leg portion and the lip portion. When attached to the underside of the toilet seat, the lip portion may extend downward against the outer side of the rim of the toilet bowl or, alternatively, adjacent the inside of the rim of the toilet bowl. The leg portion includes a recess and the recess includes a slot while a single passageway extends through the body of the lip portion.

Disposed within the recess is a high impact-resistant rubber bumper insert member that provides for the shock absorption when the toilet seat is abruptly dropped or released upon the rim of the toilet bowl. The rubber bumper insert member includes two spaced-apart insert through holes that align with the slot thereby allowing screws to be inserted through the insert through holes and the slot for securing the bracket to the underside of the toilet seat.

The interior attaching surface of the bracket is further defined by a grid matrix that increases the surface contact area between the bracket and the toilet seat underside for glue bonding of the interior attaching surface to the underside of the toilet seat when glue, such as epoxy glue, is used to secure the bracket to the underside of the toilet seat.

In addition, one or more brackets can be integrally formed and molded to the underside of the toilet seat with the rubber bumper insert members capable of removable insertion within the respective recesses of the leg portions of the brackets.

It is an objective of the present invention to provide a toilet seat device attachable to the underside of the toilet seat for preventing the toilet seat from sliding back and forth upon the rim of the toilet bowl.

It is another objective of the present invention to provide a toilet seat device that is attachable to the underside of the toilet seat and which is able to absorb the shock that occurs when the toilet seat is slammed or dropped upon the rim of the toilet bowl.

It is yet another objective of the present invention to provide a toilet seat device that has an increased bonding and attachment surface area on one of its sides for enhancing the securement of the device to the underside of the toilet seat.

It is still yet another objective of the present invention to provide a toilet seat device that can be molded and adjoined to the toilet seat as an integral part thereof.

It is still yet a further objective of the present invention to provide a toilet seat device that is secured to the underside of the toilet seat by either glue bonding or by being screwed into the underside of the toilet seat.

A further objective of the present invention is to provide a toilet seat device whereupon several devices are attachable at various positions or locations upon the underside of the toilet seat, on either the inside or outside thereof, for obtaining the optimum results of toilet seat slide prevention and shock absorption.

A still further objective of the present invention is to provide a toilet seat device attachable to the underside of the toilet seat for reducing and eliminating the wear, maintenance, and repair that would be required for a cracked toilet seat.

Still another objective of the present invention is to provide a toilet seat device attachable to the underside of the toilet seat wherein the shock absorption member is removably insertable and securable to the bracket of the device.

Still yet another objective of the present invention is to provide a toilet seat device attachable to the underside of the toilet seat that reduces the need to repair or replace the toilet seat by reducing or eliminating damage, neglect, and abuse thereto.

Yet another objective of the present invention is to provide a toilet seat device attachable to the underside of the toilet seat that allows weight placed upon the toilet seat to be distributed evenly thereby preventing wear to the seat supports of the toilet seat and also preventing the premature replacement purchase of a new toilet seat.

Yet still another objective of the present invention is to provide a toilet seat device that is attachable to the underside of the toilet seat wherein the device is attachable to any existing toilet seat and also available as a retrofitted item.

Yet still a further objective of the present invention is to provide a toilet seat device that is attachable to the underside of the toilet seat wherein the device is manufactured from durable materials to insure a long and useful life, and wherein installation is easy and quick by using screws, glue, or a combination of both.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Figure 1:
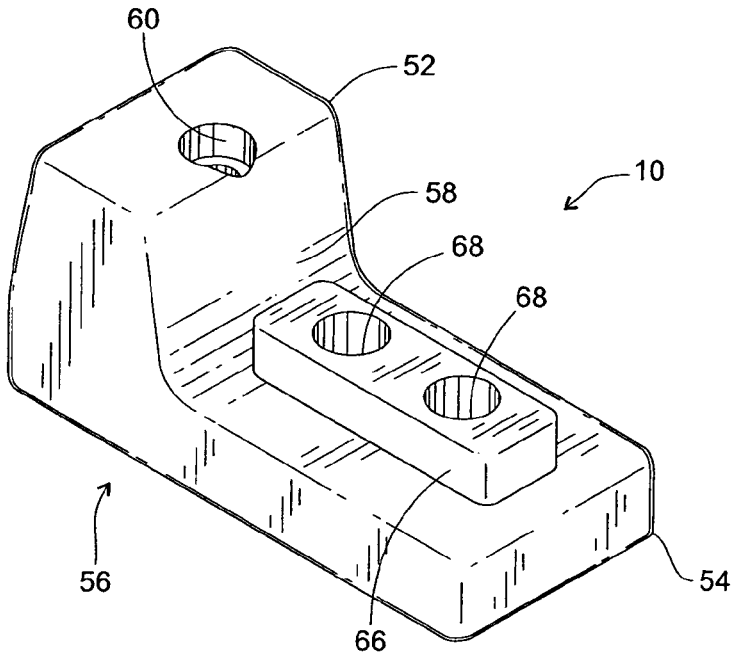
FIG. 1 is a perspective view of the toilet seat device of the present invention illustrating the rubber bumper insert member seated within the recess of the bracket.
Figure 2:
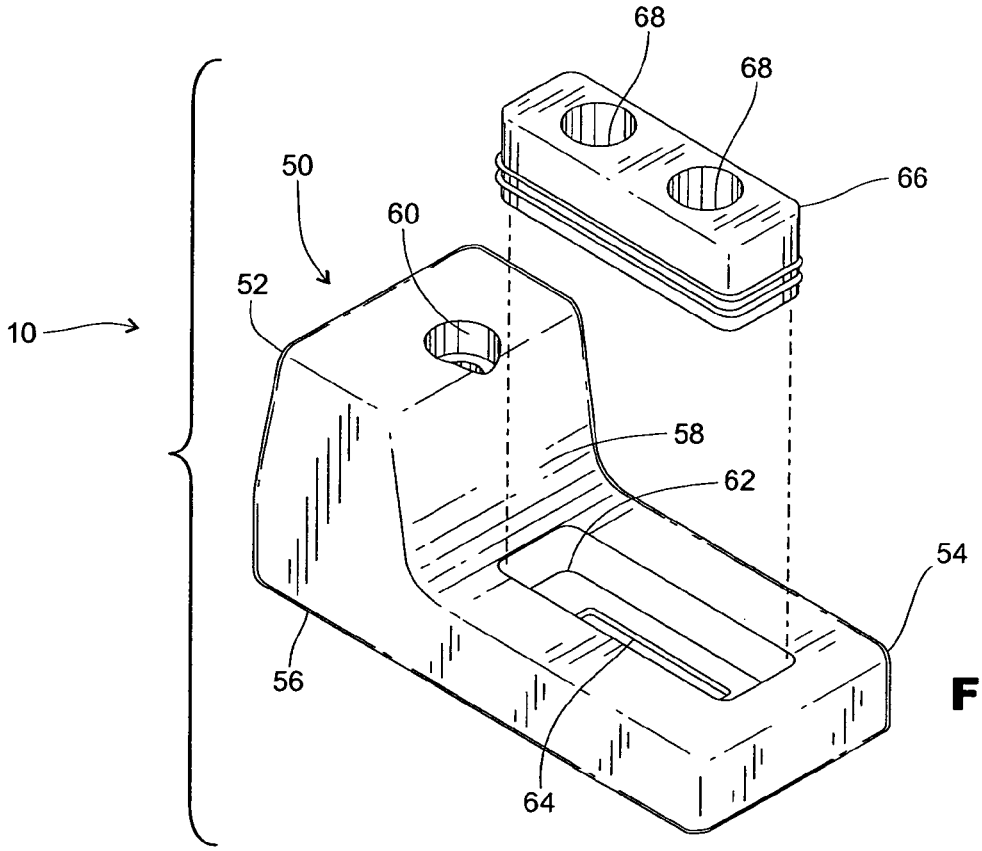
FIG. 2 is an exploded view of the toilet seat device of the present invention showing the alignment of the rubber bumper insert member prior to its attachment to the bracket.

Illustrated in FIGS. 1-9 is a device 10 for mounting to the toilet seat (actually for optimal results at least four devices 10 should be used) that allows for the even distribution of weight thereupon in order to prevent wear to the seat supports which uneven weight distribution and consequent wear results in premature toilet seat replacement. In addition, when mounted to the toilet seat the device 10 prevents the toilet seat from moving and sliding back and forth which movement over time loosens and breaks the seat support; and the device 10 incorporates a shock absorption member that cushions and absorbs the shock to the toilet seat when it is abruptly released and dropped and slammed on the rim of the toilet bowl.

Thus, shown in FIGS. 3-6 and 8 and 9, is a conventional toilet 12 that includes a water closet or tank 14 having a lid 16 and a flush lever 18 mounted thereto. The water closet 14 s interconnected to a toilet bowl 20 that has a base 22 for mounting to the floor. The toilet bowl 20 includes an upper generally circular rim 24 that defines an outer side 26 and an inner side 28. A toilet seat 30 is pivotally or hingably mounted to the rear of the toilet 12 by any manner of conventional seat supports 32, and the toilet seat 30 is commensurate in size with the rim 24 and the toilet seat 30 generally covers the rim 24 when disposed to its use position. The toilet seat 30 also includes an underside 34 and an opposite upper side 36. As specifically shown in FIG. 9, relative to the toilet seat 30 being in the non-use position and lifted up adjacent the water closet 14, various device mounting positions can be defined. For reference purposes the 12 o'clock position 38 is adjacent the attachment of the toilet seat 30 to the seat supports 32 while the 6 o'clock position 40 is directly opposite and at what would be the open end. Consequently, the 3 o'clock and 4 o'clock positions 42 and 44 can be defined and opposite 8 o'clock and 9 o'clock positions 46 and 48 can also be defined; and these positions are one preferred mounting arrangement or distribution for four of the devices 10.

The device 10 includes an elongated, somewhat L-shaped bracket 50. The bracket 50 further defines a lip portion 52 and a leg portion 54. The leg portion 54 and the lip portion 52 are integrally attached, adjoined, or formed to each or together. The bracket 50 includes an interior bonding and attaching surface 56 that is coextensive with the leg portion 54 and the lip portion 52 and an opposite outer toilet bowl side 58. The interior surface 56 is the surface of the bracket 50 disposed contiguous to the underside 34 of the toilet seat 30 when the device 10 is attached thereto and the opposite outer toilet bowl side 58 faces the rim 24 of the toilet bowl 20. A passageway 60 extends through the body of the lip portion 52 of the bracket 50 and communicates at its opposed ends with the interior attaching surface 56 and the outer toilet bowl side 58. Furthermore, the lip portion 52 defines the front of the device 10 and the leg portion 54 defines back or rear of the device 10.

As shown in FIGS. 1, 2, 5, and 9, the leg portion 54 includes a rectangular-shaped recess 62 that extends through the leg portion 54 and registers with both the interior attaching surface 56 and the outer toilet bowl side 58. A slot 64 further defines and is formed from the recess 62, and the slot 64 extends longitudinally commensurate with the recess 62. A rubber bumper insert member 66 is removably insertable into the recess 62, and the insert member 66 is generally press fit into the recess 62 and provides for the shock absorption for the toilet seat 30 when the toilet seat 30 is dropped or slammed onto the rim 24 of the toilet bowl 20. Thus, irrespective of the placement of one or more devices 10 on the underside 34 of the toilet seat 30, the insert member 66 will always face the rim 24 of the toilet bowl 20. The rubber bumper insert member 66 is preferably manufactured from a high impact-resistant rubber, and includes at least one pair of spaced-apart insert through holes 68. The insert through holes 68 align with the slot 64 of the recess 62 that is formed on the leg portion 54 when the insert member 66 is placed within the recess 62.

Figure 5:
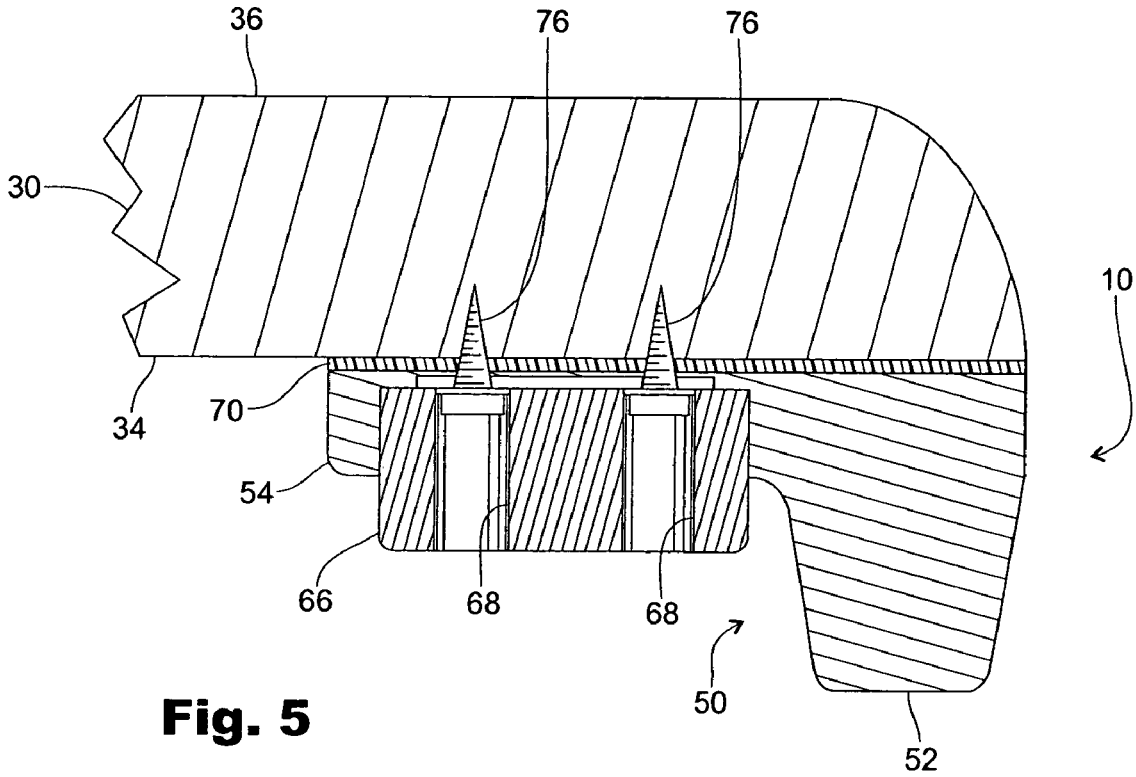
FIG. 5 is a sectioned elevational view taken along lines 5-5 of FIG. 4 of the toilet seat device of the present invention illustrating the securement of the toilet seat device to the underside of the toilet seat by being screwed thereto.
Figure 7:
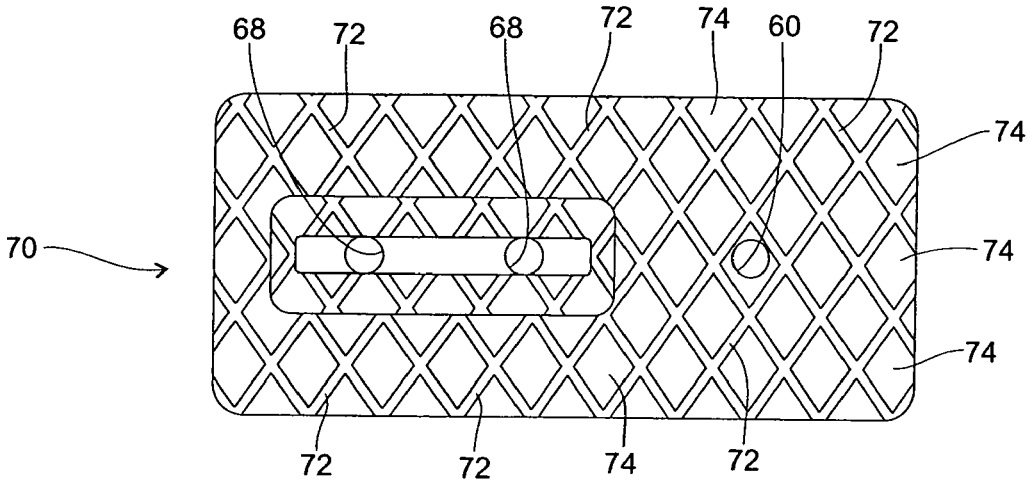
FIG. 7 is a bottom plan view of the toilet seat device of the present invention illustrating the grid matrix formed on the attaching surface of the bracket that increases the surface contact area for bonding and securing the bracket to the underside of the toilet seat.

As illustrated most distinctly in FIGS. 5 and 7, the interior attaching surface 56 is further includes a grid matrix 70 formed thereon; and the grid matrix 70 is formed by a plurality of interlocking and crisscrossing grid members 72 that form a plurality of reservoirs or cavities 74 therebetween. The surface area of the interior attaching surface 56 is thus increased by having the grid matrix 70 formed thereon, and this increased surface contact area enhances and insures the securement of the device 10 to the underside 34 of the toilet seat 30 as will be hereinafter further described.

There are several means to secure the device 10 to the underside 34 of the toilet seat 30. One securement means is shown in FIG. 5, and it includes inserting two fasteners 76, such as brass or stainless steel screws, through the insert through holes 68 of the insert member 66, and through the slot 64 for securement into the toilet seat 30 from the underside 34 thereof. A second means includes applying a bonding material, agent, substance, or glue (epoxy glue) to the entire grid matrix 70 whereupon the bonding agent, substance, material or glue will spread throughout and permeate into the reservoirs or cavities 74 of the grid matrix 70 so that the interior attaching surface 56 can be pressed against the underside 34 of the toilet seat 30 for bonding and securing the device 10 thereto. Thus, the device 10 is capable of being secured to the underside 34 of the toilet seat 30 by being bonded, screwed thereinto, or a combination of both securement means. It should be noted that the bracket 50 can be manufactured and composed of a number of materials, including, but not limited to, high impact plastics, PVC, nylon, brass and billet aluminum.

Figure 6:
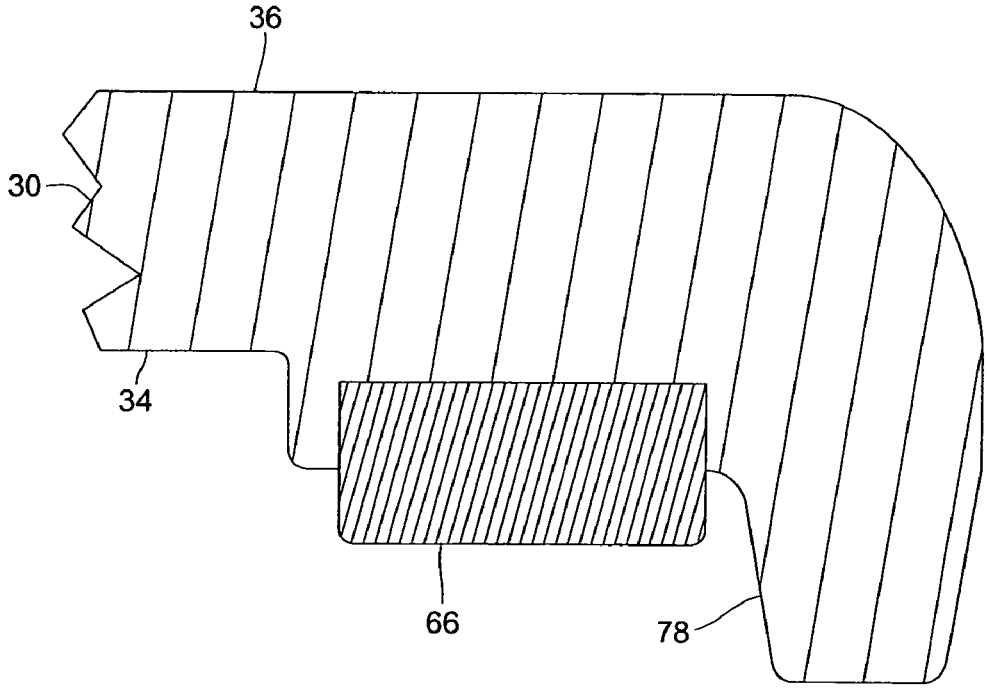
FIG. 6 is a side elevational view of the toilet seat device of the present invention illustrating the integral molding of the toilet seat device to the underside of the toilet seat and the disposition of the rubber bumper insert member within the recess of the bracket.

In addition to the configuration of the toilet seat device 10 as an item that can be attached to the toilet seat 30 by the consumer or retrofitted to the toilet seat 30, an alternative embodiment is shown in FIG. 6 wherein a bracket 78 of the device 10 is integrally molded to the underside side 34 of the toilet seat 30. The device 10 could be so molded that the lip portion 52 extends adjacent and along the outer side 26 of the rim 24 of the toilet bowl 20; or the device 10 could be molded so that the lip portion 52 extends adjacent and downwardly along the inner side 28 of the toilet bowl 20.

Figure 3:
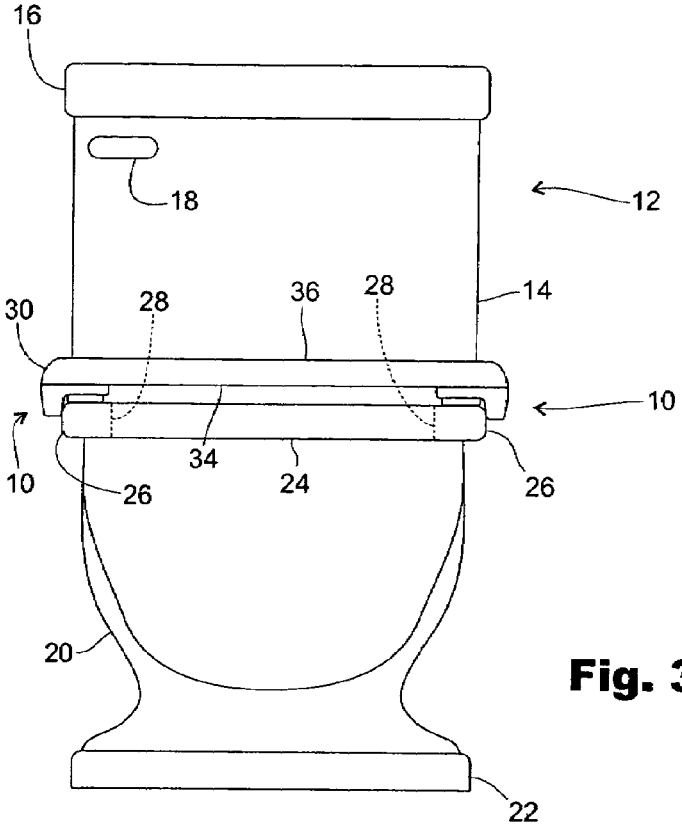
FIG. 3 is a front elevational view of the toilet seat device of the present invention illustrating the disposition and securement of two devices to the underside of the toilet seat and against the outer side of the rim of the toilet bowl.
Figure 4:
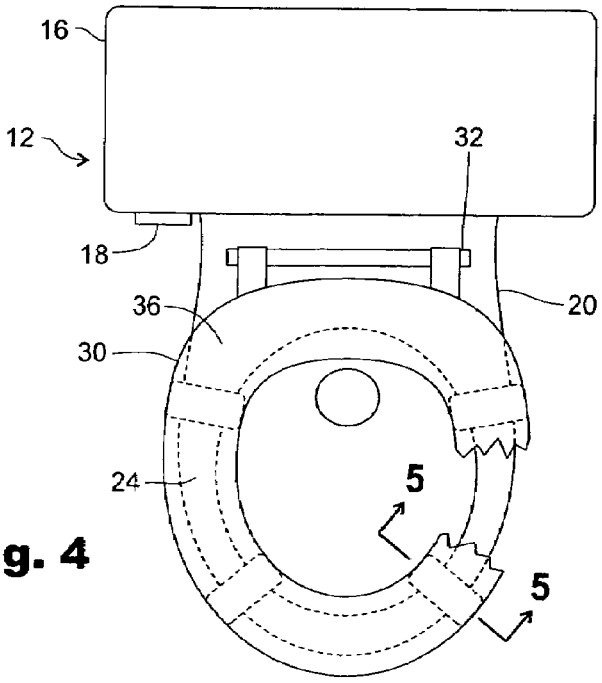
FIG. 4 is a top plan view of the toilet seat device of the present invention illustrating the disposition and securement of four devices at various spaced locations on the underside of the toilet seat.
Figure 8:
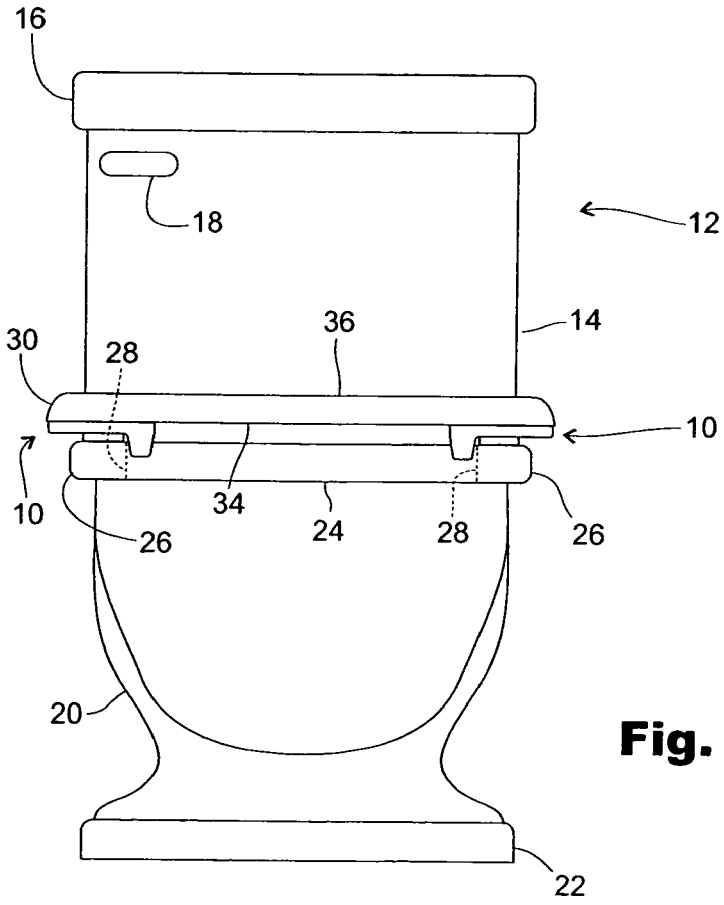
FIG. 8 is a front elevational view of the toilet seat device of the present invention illustrating the disposition of two devices that are mounted to the underside of the toilet side and adjacent the inside of the rim of the toilet bowl.
Figure 9:
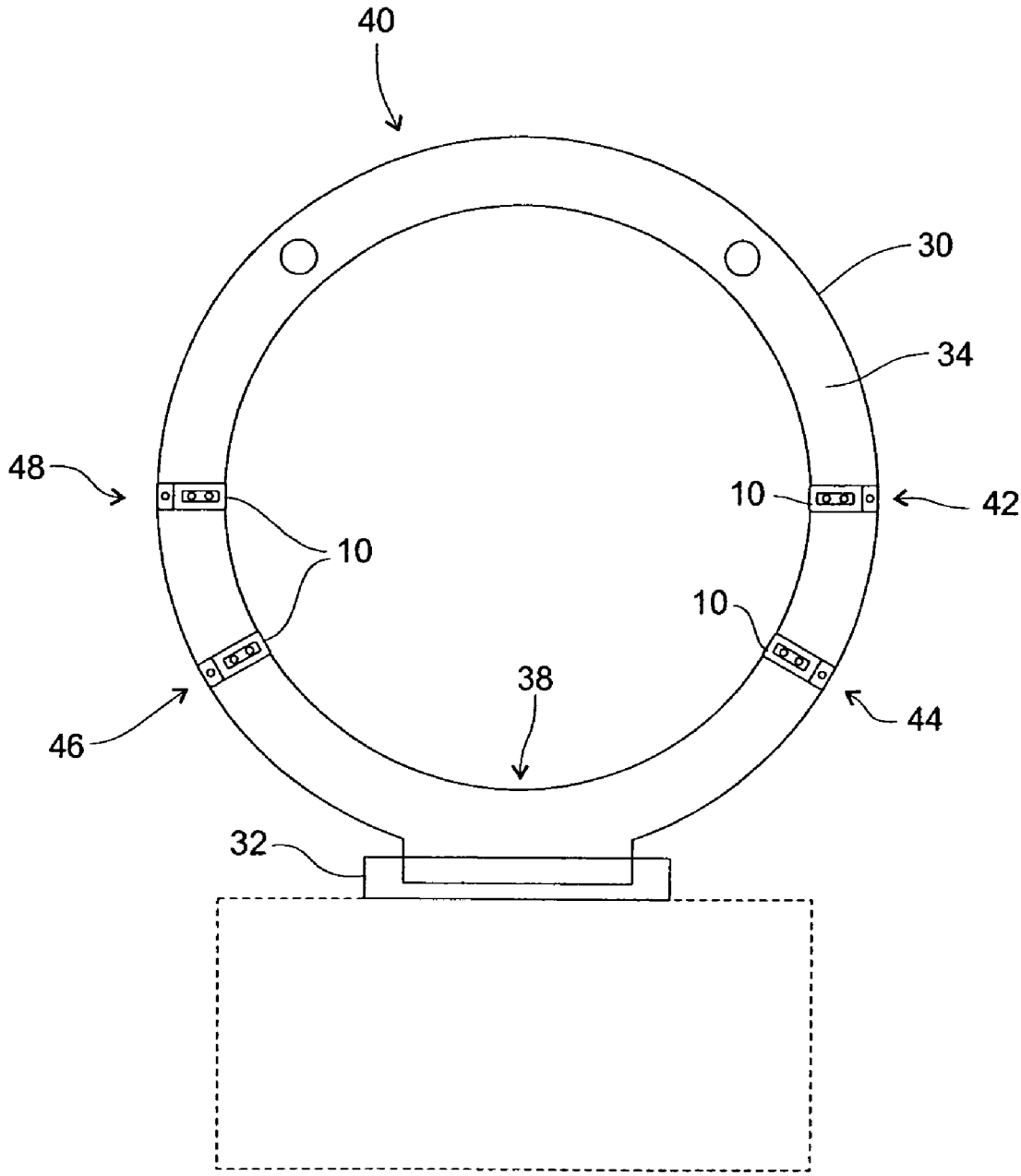
FIG. 9 is a front elevational view of the toilet seat device of the present invention illustrating the toilet seat in an schematically raised position to show various positions for attaching the device to the underside of the toilet seat.

Illustrated in FIGS. 3, 4, 8, and 9, are several representative arrangements for a plurality of toilet seat devices 10 mounted on and spaced about the underside 34 of the toilet seat 30. In FIGS. 3 and 4, four devices 10 are mounted, either by screwing or bonding, to the underside 34 of the toilet seat 30 so that their lip portions 52 extend downwardly against the outer side 26 of the rim 24 of the toilet bowl 20. FIG. 3 shows the insert member 66 inserted into the recess 62 of the leg portion 54 for cushioning the toilet seat 30 against the rim 24 of the toilet bowl 20. In contradistinction, FIG. 8 shows two toilet seat devices 10 mounted to the underside 34 of the toilet seat 30 with the lip portions 52 extending downwardly adjacent the inner side 28 of the rim 24. FIG. 9 shows four devices 10 mounted in one preferred arrangement wherein the devices 10 are located, respectively, at the 3 o'clock position 42, the 4 o'clock position 44, the 8 o'clock position 46, and the 9 o'clock position 48.

The present invention has been shown and described herein in what is believed to be the most practical and preferred embodiments; nonetheless, it is recognized that departures may be made therefrom within the scope the invention, and that obvious modifications, alterations, changes, and variations will occur to those skillful in the art while remaining within the scope of the invention as set forth in this specification and appended claims.

I claim:

1. A toilet seat device for mounting to the underside of a toilet seat for preventing the toilet seat from sliding upon the toilet, comprising:

a lip portion;

the lip portion including a passageway extending therethrough;

a leg portion integrally attached to the lip portion;

an interior attaching surface coextensive with the lip portion and the leg portion;

an opposite outer side coextensive with the lip portion and the leg portion;

a grid matrix formed on the interior attaching surface;

the leg portion including a recess;

a rubber bumper insert member removably insertable into the recess of the leg portion for providing shock absorption for the toilet seat when the toilet seat is dropped on the toilet;

the rubber bumper insert member including a pair of spaced-apart insert through holes; and whereupon the interior attaching surface is disposed contiguous to the underside of the toilet seat for securing the toilet seat device to the underside thereof for preventing the toilet seat from sliding upon the toilet and for providing shock absorption for the toilet seat when the toilet seat is dropped upon toilet.

2. The toilet seat device of claim 1 wherein the leg portion includes a slot that is smaller than the recess and which aligns with the insert through holes of the rubber bumper insert member when the rubber bumper insert member is inserted in the recess.

3. The toilet seat device of claim 2 when the grid matrix increases the surface area contact of the interior attaching surface with the underside of the toilet seat for enhancing the securement of the device to the toilet seat when the toilet seat device is secured to the toilet seat by being bonded thereto.

4. A toilet seat device for mounting to the underside of a toilet seat that is pivotally secured to a toilet having a toilet bowl and the toilet bowl including a rim having an inner side and an outer side, comprising:

a lip portion;

the lip portion including a passageway extending therethrough;

a leg portion integrally attached to the leg portion;

an interior attaching surface coextensive with the lip portion and the leg portion;

an opposite outer side coextensive with the lip portion and the leg portion;

a grid matrix formed on the interior attaching surface for increasing the surface contact area of the interior attaching surface with the underside of the toilet seat;

the leg portion including a recess;

a rubber bumper insert member removably insertable into the recess of the leg portion for providing shock absorption for the toilet seat when the toilet seat is dropped upon the rim of the toilet;

the rubber bumper insert member including a pair of spaced-apart insert through holes; and whereupon the interior attaching surface is disposed contiguous to the underside of the toilet seat for securing the toilet seat device to the underside thereof with the lip portion extending alongside the inner side and the outer side of the rim of the toilet thereby preventing the toilet seat from sliding on the toilet and for providing shock absorption for the toilet seat when the toilet seat is dropped upon the toilet.

5. The toilet seat device of claim 4 wherein the leg portion includes a slot that is smaller than the recess and which aligns with insert through holes of the rubber bumper insert member when the rubber bumper insert member is inserted in the recess.

6. The toilet seat device of claim 5 wherein the grid matrix increases the surface contact area of the interior attaching surface with the underside of the toilet seat for enhancing the securement of the device to the toilet seat when the toilet seat device is secured to the toilet seat by being bonded thereto.

* * * * *